US007483043B2

(12) United States Patent
Morgan et al.

(10) Patent No.: US 7,483,043 B2
(45) Date of Patent: Jan. 27, 2009

(54) SPATIAL-TEMPORAL MULTIPLEXING

(75) Inventors: Daniel J. Morgan, Denton, TX (US); Jeffrey M. Kempf, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 127 days.

(21) Appl. No.: 11/419,578

(22) Filed: May 22, 2006

(65) Prior Publication Data

US 2006/0197776 A1 Sep. 7, 2006

Related U.S. Application Data

(62) Division of application No. 09/795,402, filed on Feb. 26, 2001, now Pat. No. 7,075,506.

(60) Provisional application No. 60/184,949, filed on Feb. 25, 2000.

(51) Int. Cl.
*G09G 5/10* (2006.01)

(52) U.S. Cl. ..... 345/690; 345/88; 345/89; 345/204; 345/693; 348/770; 348/771; 358/518; 358/519; 358/521; 358/534; 382/168; 382/169; 382/237

(58) Field of Classification Search ..... 345/89, 345/690–693, 87, 88
See application file for complete search history.

(56) References Cited

U.S. PATENT DOCUMENTS 5,543,941 A * 8/1996 Parker et al. ..... 358/534
5,588,024 A * 12/1996 Takano ..... 375/242

(Continued)

OTHER PUBLICATIONS

Pending U.S. Appl. No. 09/088,674, filed Jun. 2, 1998 (not published).
Pending U.S. Appl. No. 09/573,109, filed Sep. 17, 2000 (not published).

*Primary Examiner*—Richard Hjerpe
*Assistant Examiner*—Jennifer T Nguyen
(74) *Attorney, Agent, or Firm*—Charles A. Brill; Wade James Brady, III; Frederick J. Telecky, Jr.

(57) ABSTRACT

A method and system for performing spatial temporal multiplexing using a multi-threshold mask. A mask generator (404) outputs a threshold value for each pixel of a display. The mask generator typically creates a blue noise mask for a given pixel array that is replicated over the face of the entire display. The blue noise mask generator (404) typically is implemented as a memory lookup table. An index generator (402) provides an offset into the memory lookup table that allows the table to be shifted from time to time. The output of the blue noise mask generator (404), which may be the threshold value itself or a signal representing which threshold is being used, is an input to a selective inverter (406). The selective inverter (406) provides the option of inverting the blue noise mask. To reduce artifacts, the mask is periodically shifted and/or inverted. The value from the mask generator (404), whether inverted or not, is compared to the LSBs of the input data word to yield the fractional bit values. The data adjust block (410) receives the LSBs of the input data word and apportions the intensity between the various fractional bits and perhaps one or more binary bit. Allocating the data between the fractional and binary bits allows the gradual feathering in of each more significant bit as the image intensity word increases.

6 Claims, 2 Drawing Sheets

U.S. PATENT DOCUMENTS

| | | | | |
|---|---|---|---|---|
| 5,616,228 | A | 4/1997 | Nasu et al. | |
| 6,310,591 | B1 | 10/2001 | Morgan et al. | |
| 6,324,006 | B1 | 11/2001 | Morgan | |
| 6,445,505 | B1 | 9/2002 | Morgan | |
| 6,567,134 | B1 * | 5/2003 | Morgan | 348/743 |
| 6,690,389 | B2 | 2/2004 | Ulichney | |
| 6,774,916 | B2 | 8/2004 | Pettitt et al. | |
| 7,075,506 | B2 | 7/2006 | Morgan et al. | |

* cited by examiner

200

| | | | |
|---|---|---|---|
| 9 | 1 | 12 | 8 |
| 11 | 6 | 3 | 15 |
| 0 | 4 | 14 | 13 |
| 7 | 10 | 2 | 5 |

302

| | | | | | | | |
|---|---|---|---|---|---|---|---|
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |
| 15 | 13 | 11 | 9 | 7 | 5 | 3 | 1 |

→

304

| | | | | | | | |
|---|---|---|---|---|---|---|---|
| 1 | 1 | 0 | 1 | 0 | 1 | 0 | 0 |
| 1 | 1 | 1 | 0 | 0 | 0 | 0 | 0 |
| 1 | 1 | 0 | 0 | 1 | 1 | 0 | 0 |
| 1 | 1 | 1 | 1 | 0 | 0 | 1 | 0 |
| 1 | 1 | 0 | 1 | 0 | 1 | 0 | 0 |
| 1 | 1 | 1 | 0 | 0 | 0 | 0 | 0 |
| 1 | 1 | 0 | 0 | 1 | 1 | 0 | 0 |
| 1 | 1 | 1 | 1 | 0 | 0 | 1 | 0 |

SPATIAL-TEMPORAL MULTIPLEXING

This application is a divisional of application No. 09/795,402, filed Feb. 26, 2001, now U.S. Pat. No. 7,075,506 which claims the benefit of provisional Application No. 60/184,949, filed Feb. 25, 2000.

CROSS-REFERENCE TO RELATED APPLICATIONS

The following patents and/or commonly assigned patent applications are hereby incorporated herein by reference:

| Pat. No. | Filing Date | Issue Date | Title |
|---|---|---|---|
| 5,616,228 | Jun. 5, 1996 | Apr. 8, 1997 | Method For Reducing Temporal Artifacts in Digital Video |
| 09/088,674 | Jun. 2, 1998 | | Boundary Dispersion For Mitigating PWM Temporal Contouring Artifacts In Digital Displays |
| 09/572,470 | May 17, 2000 | | Spoke Light Recapture In Sequential Color Imaging Systems |
| 09/573,109 | May 17, 2000 | | Mitigation Of Temporal PWM Artifacts |
| TI-30641 | Herewith | | Contour Mitigation Using Parallel Blue Noise Dithering System |

FIELD OF THE INVENTION

This invention relates to the field of display systems, more particularly to digital display systems using pulse width modulation.

BACKGROUND OF THE INVENTION

Digital display systems typically produce or modulate light as a linear function of input image data for each pixel. For an 8-bit monochromatic image data word, the input image data word ranges from 0 to 255. A value of 0 results in no light being transmitted to or produced by a pixel, 255 is the maximum intensity level for a pixel, and 128 is mid-scale light.

Pulse width modulation (PWM) schemes typically modulate a constant intensity light source in periods whose length increases by a power of two. For example, when 5 mS is available for each color of a three-color system the element on times for one 8-bit system are 20 μS, 40 μS, 80 μS, 160 μS, 320 μS, 640 μS, 1280 μS, and 2560 μS. If a given bit for a particular pixel is a logic 0, no light is transmitted to or generated by the pixel. If the bit is a logic 1, then the maximum amount of light is transmitted to or generated by the pixel during the bit period. The viewer's eye integrates the light received by a particular pixel during an entire frame period to produce the perception of an intermediate intensity level.

One problem encountered by PWM display systems is the difficulty in creating very small intensity resolution steps. As the contrast ratio of the display system increases, it becomes much more difficult to create small enough steps between intensity levels. While a one least significant bit (LSB) intensity step is not generally objectionable when the image being displayed is very bright, it can be very objectionable in a dim region of an image. Unfortunately, the LSB intensity step size cannot be made arbitrarily small. Image data for each bit period must be loaded into each pixel of the display device.

Very small LSB periods are limited by the amount of data that can be loaded during the frame period or portion thereof. Additionally, the display device itself has some finite response time. For example, digital micromirror devices require not only a certain amount of time to load the memory array underlying the mirror array, but also a finite amount of time to reset the mirrors and allow them to transition from one position to the next.

Another problem encountered by PWM display systems is the creation of visual artifacts that arise due to the generation of an image as a series of discrete bursts of light. While stationary viewers perceive stationary objects as having the correct intensity, motion of the viewer's eye or motion in the image can create an artifact know as PWM temporal contouring. PWM temporal artifacts are described in U.S. Pat. No. 5,619,228. PWM temporal artifacts are created when the distribution of radiant energy is not constant over an entire frame period and may be noticeable when there is motion in a scene or when the eye moves across a scene.

When the eye moves across a scene, a given point on the retina of the eye accumulates light from more than one image pixel during the eye's integration period. If the various pixels are all displaying the same intensity in the same way—the discrete bursts of light are occurring simultaneously for all pixels—the perceived pixel intensity will be correct. If the various pixels are not displaying the same intensity in the same way the eye may falsely detect bright flashes. This happens when the discrete bright periods of a first pixel are created during a first portion of the frame period and the eye then scans to a second pixel that uses the next portion of the frame period to display the light. Since the same point on the retina receives the light from the first pixel and the second pixel in rapid succession—less than the decay period of the eye—that point of the retina perceives a single pixel as bright as the sum of the first and second pixels. This PWM temporal contouring artifact appears as a noticeable pulsation in the image pixels. This pulsation is time-varying and creates apparent contours in an image that do not exist in the input image data.

PWM temporal contouring is most clearly seen when viewing a grayscale ramp that increases horizontally across an image. As the image data on each line increase from 0 on the left of the row to 255 on the right, there are several places along each row where the major bits change from a logic 0 to a logic 1. The most dramatic change is in the center of each row where one pixel has a binary value of 127, which results in the first seven bits being a logic 1, and the adjacent pixel to the right having a binary value of 128, which results in the first seven bits being a logic 0 and the most significant bit being a logic 1.

If the image data is displayed over time in order of decreasing bit magnitude, that is b7, b6, b5, b4, b3, b2, b1, and b0, a viewer scanning from left to right may see an abnormally bright region at the 127 to 128 transition. This abnormal brightness is due to the viewer's eye integrating the last half of a given frame of pixel data 127—during which all bits 6:0 are all on—with the first half of the next frame—during which bit 7 is on for the entire half-frame. The net effect of the integration of the last half of the 127-valued pixel and the first half of the 128-valued pixel is a pixel having an intensity value of 255. The same artifact occurs when the pixel data is moving and the viewer's eye is stationary, and at the lower bit transitions.

When viewed at a normal viewing distance, the PWM contouring artifact created by two adjacent pixels is very difficult, if not impossible, for the typical viewer to detect. In real images, however, the bit transitions often occur in areas having a large number of adjacent pixels with virtually identical image data values. If these large areas of similar pixels have clusters whose intensity values cross a major bit transition, the PWM contouring is much easier to detect.

One method of reducing the PWM temporal contouring artifact uses bit splitting. Bit splitting divides the long periods during which the more significant bits are displayed into two or more shorter bits and distributes them throughout the frame period. For example, an 8-bit system may divide the MSB, having a duration of 128 LSB periods, into four equal periods each requiring 32 LSB periods and distributed throughout the frame period.

Bit splitting techniques reduce most of the objectionable PWM temporal artifacts. Unfortunately, bit splitting increases the necessary bandwidth of the modulator input since some of the data must be loaded into the system multiple times during a single frame period.

Given the quantization and temporal artifacts created by PWM displays, a method and system of producing very small intensity changes and eliminating noticeable temporal artifacts is needed.

SUMMARY OF THE INVENTION

Objects and advantages will be obvious, and will in part appear hereinafter and will be accomplished by the present invention which provides a method and system for spatial temporal multiplexing using multi-level threshold masks. One embodiment of the claimed invention provides a method of creating fractional display bits, the method comprising: receiving a series of pixel values representing an array of pixels; comparing the pixel values to a selected threshold value, the threshold values having more than two distinct values and corresponding to a desired display bit density; and enabling a pixel corresponding to the pixel value based on the outcome of the comparison.

Another embodiment of the claimed invention provides a multi-level mask for creating fractional display bits comprising: an array of mask cells; and a threshold value in each mask cell. The threshold values in the mask array are chosen to enable a desired density of pixels controlled by the array dependent on the relative magnitude of a pixel intensity value and the threshold value.

Another embodiment of the claimed invention provides a method of inverting a display bit mask. The method comprising: receiving a value for a cell of a first display bit mask; subtracting the received value from a maximum bit mask value; and using the result of the subtracting step as an inverted mask cell value.

Another embodiment of the claimed invention provides a method of operating a pulse width modulated display. The method comprising: receiving an n-bit pixel value word corresponding to a desired pixel intensity for a given pixel; enabling the given pixel during one or more whole display bit periods depending on the value of at least one of the n pixel value word bits; generating a threshold value; comparing at least a portion of the n-bit pixel value word to the threshold value; and enabling the given pixel during at least one fractional bit period depending on the result of the comparison step.

Another embodiment of the claimed invention provides a method of smoothly transitioning to a display bit period. The method comprising: receiving an input intensity data value for a pixel; allocating the input intensity data value between a binary portion and a fractional portion; comparing the fractional portion to a threshold value to determine at least one fractional display bit; and enabling the pixel during display periods corresponding to the fractional display bits and bits representing the binary portion, wherein the allocating results in a dithering allocation between at least two display bits as a magnitude of the received input intensity data value increases.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figures 1, 2, 3:
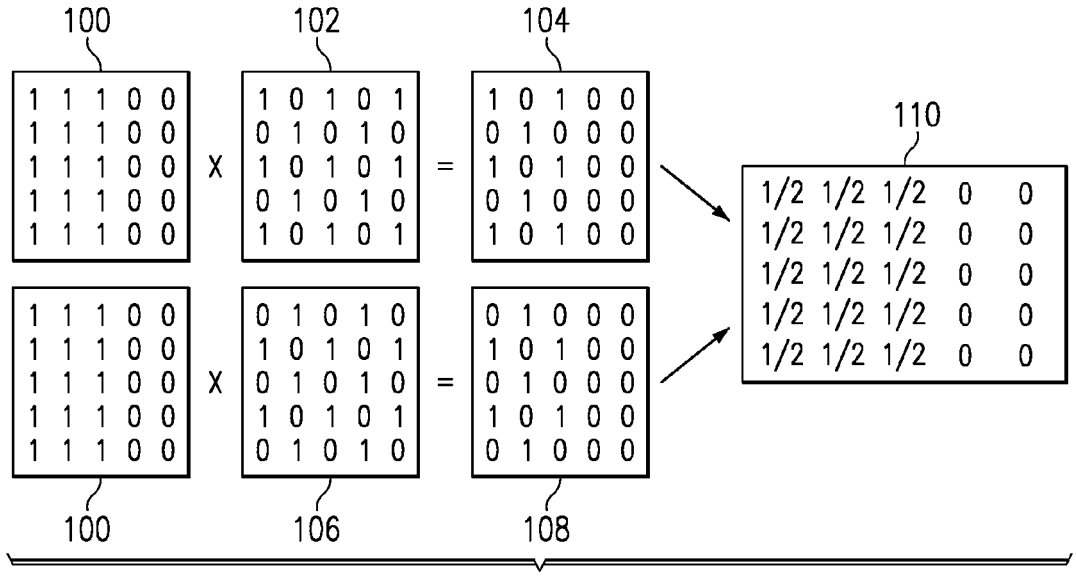
FIG. 1 (PRIOR ART)
FIG. 1 is a diagram showing the operation of spatial temporal multiplexing used in the prior art.
FIG. 2 is a simplified blue noise mask for a 4×4 pixel array.
FIG. 3 is a diagram showing a input data for an 8×8 pixel array and the resulting 8×8 bit plane after the input data has been masked by the multi-level mask of FIG. 2.

A new pulse width modulation display method has been developed that greatly reduces the PWM quantization and temporal contouring errors associated with prior PWM display systems. The new method allows much finer control of fractional display bits, virtually eliminating noticeable quantization contouring. The new method also enables each successive higher order bit to be gradually phased in to reduce PWM temporal contouring. The new method relies on a large multi-level mask to reduce the duty cycle of the fractional bits. Preferably the multi-level mask does not have a low-frequency component so that the eye is unable to detect the mask. Preferably the mask is altered, by changing the mask values and/or moving the mask relative to the image, at a rate high enough to avoid detection of the mask.

As discussed above, typical PWM display systems individually control the duty cycle of each pixel to form an image. At any given time, each pixel of the display typically can only assume either a full-on or full-off state. Intermediate intensity levels are created by controlling the duty cycle of the pixel during each frame time. Intensity data typically is received as a binary word representing the intensity of a given color for a particular pixel. Modulators such as the digital micromirror device rearrange the data into bit planes. Each bit plane is comprised of one equal weighted bit for each pixel of an image. For example, data for a three color, 24-bit per pixel, 640×480 pixel image is received as a series of 307,200 separate 24 bit words, or perhaps three series of 307,200 separate 8 bit words, and reformatted as a series of 24 640×480 bit arrays or bit planes.

Pulse width modulated displays divide the frame period into a series of binary-weighted bit periods. Each of the bit planes determines the state of the pixel, either full-on or full-off, during the corresponding bit period. Many of the bit periods, in particular the larger bit periods, are divided into one or more periods the sum duration of which is proportional in time to the bit weight. For example, the most significant bit of an 8-bit intensity word controls the pixel for 128/255ths of the total word display period. This total duration may be implemented by dividing the MSB period into 8 periods, each 16/255ths of the total word display period.

A single-modulator display system sequentially produces three single color images to provide the perception of a full color image. A three-modulator display system delivers three single color images to the display screen simultaneously to allow the viewer's eye to integrate the images and perceive a full-color image. In a parallel color display system, each single-color intensity work is used during the entire frame period. In a sequential color system, each single-color intensity word is used during roughly one-third of the frame period. Furthermore, to reduce color artifacts, sequential color systems may produces multiple single-color images in a single frame time. For example, a sequential color display system may create red, green, blue, white, red, green, and blue images in a single frame period.

Each intensity data bit may only be displayed during one of multiple single color display periods. For example, the LSB period by only be used during the first of two single color display periods. For simplicity, the following discussion will describe the display as if it were a monochromatic display system creating a single image during the entire frame period. Of course, the concepts discussed are preferably applied to both parallel color and sequential color display systems.

As discussed above, display panels have a minimum response period. This minimum response period is the time it takes each pixel element of the display panel to switch from on to off. For a micromirror device, the minimum response period is the time it takes to reset and deflect a mirror. For an LED array the minimum response period is the time it takes to turn the LED on or off. The time it takes to load the display panel with new data may be considered the practical minimum response time since even though the panel will operate faster, there may not be any practical use for operating the display panel faster than the data load rate. In a simple PWM display, the minimum response period determines the number of gray levels the display system can created during a given frame period. For a sequential color micromirror display system, the practical limit of simple binary bit periods at a 60 Hz frame rate is approximately 9 bits. Only 9 bits of image depth is insufficient to prevent objectionable quantization contouring in modern high contrast image systems.

One method used to create smaller bit periods is spatial temporal multiplexing (STM). Spatial temporal multiplexing, illustrated in FIG. 1, uses a checkerboard mask pattern to enable a subset of the pixels during each STM bit period. In FIG. 1, array 100 is a 5×5 portion of a bit plane. The bit plane shown has an intensity value of 0.5 LSB. The bit plane has an active bit set for each pixel in each of the three left-most columns and an inactive bit set for each pixel in each of the two right-most columns. In the top portion of FIG. 1, a first mask 102 has a 50% checkerboard pattern. The bit plane 100 and the first mask 102 are ANDed together to determine the data 104 that will be displayed for a first bit plane period.

During a second display period, perhaps later in the frame or during a second frame, a second mask 106 is ANDed with the same bit plane-which, if the second AND operation takes place during a subsequent frame may be different data than used in the first AND operation. The result 108 of the second AND operation is displayed during the second display period. The viewer's eye integrates the two displays, assuming they are both displayed within the integration time of the eye, and perceives the intensities shown in array 110. As shown in array 110, the viewer will perceive the left three columns having an intensity of 0.5 LSB as intended.

While spatial temporal multiplexing works well in many situations, it introduces visible artifacts in some images. Furthermore, spatial temporal multiplexing is limited to the bit intensities it can produce. A 50% checkerboard works well, but other patterns tend to create visible artifacts in the displayed image.

FIG. 2 illustrates one example of a three dimensional mask 200. The mask 200 is defined for an array of pixels, in this case a 4×4 array, and is tiled or replicated over the entire image. In each cell of the mask array a threshold value is stored. The use of a threshold value allows a single mask to be used on multi-bit data values. The threshold value represents the threshold intensity value necessary to turn on the corresponding pixel. For purposes of illustration and not for purposes of limitation, if the intensity value is a "3," pixels having an intensity of greater than 3 will be displayed. Of course, alternative embodiments can be constructed that enable pixels having intensities greater than and equal to the threshold value, or will enable pixels having intensities less than the threshold value, etc. The discussion of the invention and the appended claims is intended to include all of these alternatives as they are readily apparent to the artisan.

The selection of a 4×4 matrix is for purposes of illustration only. In practice, the mask typically is much larger. The larger the mask, the less likely there are to be unintended patterns created by tiling the mask across the display, but the more memory that is required to store the mask. In practice, a 32×32 pixel mask provides a good tradeoff between memory and artifact avoidance.

FIG. 3 illustrates the use of the mask 200 of FIG. 2. An input data array 302 holds data for 64 pixels of an image. The input data in each cell of the array is represented by four binary bits and takes on a value between 0 and 15. The particular data shown in FIG. 3 represents a ramp image that decreases from the left to the right. The mask 200 of FIG. 2 is replicated four times and compared to the data in array 302. The result—a "1" when the value in array 302 exceeds the threshold value of the mask 200 and a "0" when it does not—is shown in the array of FIG. 3. The resulting one-bit array 304 clearly shows the tendency of the decreasing ramp from array 302. The viewer's eye typically is unable to resolve adjacent pixels and integrates the values of nearby pixels to smooth the ramp. Repeating this operation while altering the alignment of the mask 200 and the input array 302 further smoothes the data ramp.

A 32×32 mask contains cells for 1024 pixels. Each of these pixels may have a unique data value. Therefore, a single mask array may be used to process a 10-bit binary number and arrive at a single display bit. Alternatively, a smaller number of discrete threshold levels may be used in situations in which the precision of 10 bits is not required. For example, a 6-bit threshold value in each cell of the mask provides 64 threshold levels. As the mask is used to process an increasing series of flat fields—that is, pixel arrays having the same intensity value—16 additional pixels of the 1024 pixels controlled by the mask will be enabled each time the intensity value of the flat field crosses another threshold.

Table 1 will be used to illustrate the application of the above masking techniques to a display system. The display system of this example uses 13 bits of intensity data for each pixel. The eight most significant bits (MSBs) of data represent the whole number of LSB intensity levels while the remaining 5 bits represent a fractional LSB portion. The first column of Table 1 is a decimal representation of the 13 bit binary number for the first 65 data values. In general, the patterns shown in Table 1 are repeated for the remaining 13 bit codes. The second column of Table 1 represents the decimal value of the fractional bit value represented by the 13 bit binary input intensity word.

TABLE 1

| Sample Spatial Multiplexing Values For 3 STM Bits | | | | | |
|---|---|---|---|---|---|
| 13-bit Code | 8-bit FBIT Value | Bit 1 density (0.5625) | Bit 2 density (0.75) | Bit 3 density (1.5) | Bit 4 density (2.0) |
| 0 | 0.0000 | 0.0000 | 0.0000 | 0.0000 | 0.0000 |
| 1 | 0.0313 | 0.0557 | 0.0000 | 0.0000 | 0.0000 |
| 2 | 0.0625 | 0.1113 | 0.0000 | 0.0000 | 0.0000 |
| 3 | 0.0938 | 0.1670 | 0.0000 | 0.0000 | 0.0000 |
| 4 | 0.1250 | 0.2227 | 0.0000 | 0.0000 | 0.0000 |
| 5 | 0.1563 | 0.2773 | 0.0000 | 0.0000 | 0.0000 |
| 6 | 0.1875 | 0.3330 | 0.0000 | 0.0000 | 0.0000 |
| 7 | 0.2188 | 0.3887 | 0.0000 | 0.0000 | 0.0000 |
| 8 | 0.2500 | 0.4443 | 0.0000 | 0.0000 | 0.0000 |
| 9 | 0.2813 | 0.5000 | 0.0000 | 0.0000 | 0.0000 |
| 10 | 0.3125 | 0.5557 | 0.0000 | 0.0000 | 0.0000 |
| 11 | 0.3438 | 0.6113 | 0.0000 | 0.0000 | 0.0000 |
| 12 | 0.3750 | 0.6670 | 0.0000 | 0.0000 | 0.0000 |
| 13 | 0.4063 | 0.7227 | 0.0000 | 0.0000 | 0.0000 |
| 14 | 0.4375 | 0.7773 | 0.0000 | 0.0000 | 0.0000 |
| 15 | 0.4688 | 0.8330 | 0.0000 | 0.0000 | 0.0000 |
| 16 | 0.5000 | 0.8887 | 0.0000 | 0.0000 | 0.0000 |
| 17 | 0.5313 | 0.9443 | 0.0000 | 0.0000 | 0.0000 |
| 18 | 0.5625 | 1.0000 | 0.0000 | 0.0000 | 0.0000 |
| 19 | 0.5938 | 0.8330 | 0.1670 | 0.0000 | 0.0000 |
| 20 | 0.6250 | 0.6670 | 0.3330 | 0.0000 | 0.0000 |
| 21 | 0.6563 | 0.5000 | 0.5000 | 0.0000 | 0.0000 |
| 22 | 0.6875 | 0.3330 | 0.6670 | 0.0000 | 0.0000 |
| 23 | 0.7188 | 0.1670 | 0.8830 | 0.0000 | 0.0000 |
| 24 | 0.7500 | 0.0000 | 1.0000 | 0.0000 | 0.0000 |
| 25 | 0.7813 | 0.0557 | 1.0000 | 0.0000 | 0.0000 |
| 26 | 0.8125 | 0.1113 | 1.0000 | 0.0000 | 0.0000 |
| 27 | 0.8438 | 0.1670 | 1.0000 | 0.0000 | 0.0000 |
| 28 | 0.8750 | 0.2227 | 1.0000 | 0.0000 | 0.0000 |
| 29 | 0.9063 | 0.2773 | 1.0000 | 0.0000 | 0.0000 |
| 30 | 0.9375 | 0.3330 | 1.0000 | 0.0000 | 0.0000 |
| 31 | 0.9688 | 0.3887 | 1.0000 | 0.0000 | 0.0000 |
| 32 | 1.0000 | 0.4443 | 1.0000 | 0.0000 | 0.0000 |
| 33 | 1.0313 | 0.5000 | 1.0000 | 0.0000 | 0.0000 |
| 34 | 1.0625 | 0.5557 | 1.0000 | 0.0000 | 0.0000 |
| 35 | 1.0938 | 0.6113 | 1.0000 | 0.0000 | 0.0000 |
| 36 | 1.1250 | 0.6670 | 1.0000 | 0.0000 | 0.0000 |
| 37 | 1.1263 | 0.7227 | 1.0000 | 0.0000 | 0.0000 |
| 38 | 1.1875 | 0.7773 | 1.0000 | 0.0000 | 0.0000 |
| 39 | 1.2188 | 0.8330 | 1.0000 | 0.0000 | 0.0000 |
| 40 | 1.2500 | 0.8887 | 1.0000 | 0.0000 | 0.0000 |
| 41 | 1.2813 | 0.9443 | 1.0000 | 0.0000 | 0.0000 |
| 42 | 1.3125 | 1.0000 | 1.0000 | 0.0000 | 0.0000 |
| 43 | 1.3438 | 0.8330 | 0.8330 | 0.0000 | 0.0000 |
| 44 | 1.3750 | 0.6670 | 0.6670 | 0.1670 | 0.0000 |
| 45 | 1.4063 | 0.5000 | 0.5000 | 0.3330 | 0.0000 |
| 46 | 1.4375 | 0.3330 | 0.3330 | 0.5000 | 0.0000 |
| 47 | 1.4688 | 0.1670 | 0.1670 | 0.6670 | 0.0000 |
| 48 | 1.5000 | 0.0000 | 0.0000 | 0.8330 | 0.0000 |
| 49 | 1.5313 | 0.0557 | 0.0000 | 1.0000 | 0.0000 |
| 50 | 1.5625 | 0.1113 | 0.0000 | 1.0000 | 0.0000 |
| 51 | 1.5938 | 0.1670 | 0.0000 | 1.0000 | 0.0000 |
| 52 | 1.6250 | 0.2227 | 0.0000 | 0.0000 | 0.0000 |
| 53 | 1.6583 | 0.2773 | 0.0000 | 1.0000 | 0.0000 |
| 54 | 1.6875 | 0.3330 | 0.0000 | 1.0000 | 0.0000 |
| 55 | 1.7188 | 0.3887 | 0.0000 | 1.0000 | 0.0000 |
| 56 | 1.7500 | 0.4443 | 0.0000 | 1.0000 | 0.0000 |
| 57 | 1.7813 | 0.5000 | 0.0000 | 1.0000 | 0.0000 |
| 58 | 1.8125 | 0.5557 | 0.0000 | 1.0000 | 0.0000 |
| 59 | 1.8438 | 0.6113 | 0.0000 | 1.0000 | 0.0000 |
| 60 | 1.8750 | 0.6670 | 0.0000 | 1.0000 | 0.0000 |
| 61 | 1.9063 | 0.7227 | 0.0000 | 1.0000 | 0.0000 |
| 62 | 1.9375 | 0.7773 | 0.0000 | 1.0000 | 0.0000 |
| 63 | 1.9688 | 0.8330 | 0.0000 | 1.0000 | 0.0000 |
| 64 | 2.0000 | 0.0000 | 0.0000 | 0.0000 | 1.0000 |

The third column of Table 1 shows the percentage of cells in the mask that are enabled at a given input intensity level. Because the entire 1024 cell mask is enabled in 19 increments, approximately 57 additional cells are enabled each step. The density of enabled cells multiplied by the weight of the bit shown in the first row of each of columns 3-6 equals the intensity added to the image by the masked bit. In the case of Bit 1 of Table 1, the duration of the bit plane for Bit 1 is 0.5625 LSB periods. When the input intensity data for each pixel is equal to 13, 72.27% of the cells are enabled, providing an effective pixel intensity of (0.7227*0.5625=0.4063 LSB). The second column of Table 1 shows that for an input intensity value of 13 the desired intensity is 0.4063 LSB.

Which of the 1024 cells in the 32×32 mask to enable for each intensity step are determined by the creation of a blue noise mask. A blue noise mask is designed to avoid low frequency patterns in any direction when the mask is replicated and tiled. Since the mask is replicated many times over a high definition image, the eye is very likely to spot low frequency patterns as they are repeated across the face of the display.

Once the first blue noise masked bit is fully enabled, a more significant bit is gradually turned on. As shown by the rows corresponding to input values 19-24, the density of a second blue noise masked bit, with a base intensity value of 0.75 LSB, is gradually increased while the density of the first blue noise masked bit is gradually decreased. To avoid artifacts, a second mask pattern typically is used by the second blue noise bit, Bit 2, while the first blue noise bit, Bit 1, uses a first mask pattern.

The two patterns used by the various blue noise masked bits ideally are "blue" with respect to each other. That is, over time, the pattern created by each pixel at various intensity levels should minimize the low frequency components. One method of achieving jointly-blue mask patterns is simply to invert the blue noise mask pattern. The inverted mask may be created by subtracting each threshold value from the maximum threshold value.

Mask inversion causes the cell with the highest threshold in the first mask to become the cell with the lowest threshold in the second mask. This mask inversion ensures that for any intensity level, a minority pixel in the first mask is not a minority pixel in the second mask. Stated another way, for intensity levels low enough to enable less than half of the mask cells of a first mask, none of the enabled cells will be enabled using the inverted mask. Furthermore, for intensity levels high enough to enable more than half of the mask cells in the first mask, none of the remaining disabled cells will be disabled using the inverted mask.

In addition to inverting the masks, additional masks may be used at various points in time and the original and inverted original masks may be shifted relative to the image pixel array. The constant shifting and inversion of the blue noise mask allows a single blue noise mask to be stored in permanent memory while providing a large number of useable masks during runtime.

The third bit, Bit 3 of Table 1, is also phased in over several intensity steps. In Table 1, Bit 3 is phased in over 6 intensity steps, intensity values 43-48, while Bits 1 and 2 are gradually disabled. After Bit 3 is fully enabled, Bit 1 is once again gradually enabled until, at the step from intensity level 63 to intensity level 64, Bit 4 is enabled. Bit 4 of Table 1 is not a blue noise masked bit, but rather is a standard binary weighted bit plane.

The gradual phasing in of each bit, including the first standard binary bit, Bit 4, limits the temporal contouring artifacts that otherwise might be created by an abrupt transition between pixels having energy in a first bit plane or bit planes and pixels having energy in the next more significant bit plane. The importance of this feature depends on the location of the various bit planes in the frame period. The introduction of the Bit 4 bit plane may also be phased in by dithering the data bus. Dithering the data bus phases the Bit 4 bit plane in over a range of input values. Dithering the data bus, however, introduces noise into the signal and can produce visible artifacts.

An improved method of gradually phasing in the standard binary bits is enabled by the use of non-binary data bits. The non-binary nature of the data bits is evident from the weights assigned to the first three data bits shown in Table 1. The first bit has a bit weight of 0.5625 while Bit 2 has a weight of 0.75 and Bit 3 has an assigned weight of 1.5 LSBs. Since the three blue noise masked bits equal a combined weight of 2.8125 LSBs, data can be shifted between the first three blue noise masked bits and the first true binary bit over a series of increasing input values to avoid an abrupt enabling of the first binary bit. This method enables the gradual phasing in of the binary bits without introducing dither noise into the image. This function may be implemented in a lookup table and turned on or off as desired. The function generally is not necessary at high intensity levels and may be disabled.

The multi-threshold mask described above provides the ability to achieve virtually any intermediate intensity level with a limited number of bit planes. Since the intensity easily is varied by selecting the various thresholds of the mask matrix, the duration of the pixels may be assigned an arbitrary value in terms of an LSB.

The use of an arbitrary, non-integer LSB value for each bit plane is particularly advantageous, at least in some micromirror display systems, since it allows the actual display duration of each bit to be determined by the response time of the modulator. Prior art systems were often locked into a minimum LSB value by the minimum bit display duration. Using the multi-level masks described above, the system designer can set several bit display periods equal to the minimum display period of the display and then achieve fractional bit periods through the use of the variable density provided by the mask.

Table 2 is a sample blue noise mask showing the threshold stored in each cell. Table 2 is labeled to show the rows and columns of each portion of the mask.

TABLE 2

Sample 32 × 32 Blue Noise Mask

| | C1 | C2 | C3 | C4 | C5 | C6 | C7 | C8 | C9 | C10 | C11 | C12 |
|---|---|---|---|---|---|---|---|---|---|---|---|---|
| R1 | 24 | 39 | 4 | 46 | 35 | 19 | 39 | 5 | 52 | 11 | 41 | 5 |
| R2 | 50 | 13 | 57 | 31 | 8 | 60 | 25 | 44 | 16 | 60 | 24 | 51 |
| R3 | 22 | 63 | 27 | 21 | 45 | 32 | 6 | 51 | 35 | 0 | 38 | 9 |
| R4 | 45 | 8 | 51 | 0 | 56 | 13 | 62 | 20 | 27 | 50 | 19 | 63 |
| R5 | 39 | 15 | 40 | 33 | 17 | 41 | 30 | 5 | 57 | 10 | 42 | 15 |
| R6 | 22 | 31 | 60 | 10 | 36 | 54 | 17 | 37 | 45 | 32 | 56 | 6 |
| R7 | 58 | 44 | 4 | 50 | 25 | 2 | 46 | 10 | 29 | 1 | 22 | 49 |
| R8 | 7 | 27 | 39 | 14 | 56 | 28 | 61 | 22 | 54 | 40 | 60 | 11 |
| R9 | 23 | 46 | 20 | 48 | 7 | 38 | 12 | 44 | 5 | 35 | 14 | 52 |
| R10 | 40 | 63 | 1 | 29 | 59 | 18 | 50 | 25 | 58 | 18 | 32 | 41 |
| R11 | 30 | 17 | 51 | 36 | 13 | 43 | 3 | 37 | 9 | 46 | 0 | 63 |
| R12 | 57 | 9 | 40 | 5 | 55 | 24 | 62 | 21 | 56 | 26 | 49 | 21 |
| R13 | 34 | 25 | 48 | 31 | 20 | 47 | 8 | 49 | 12 | 38 | 6 | 57 |
| R14 | 23 | 53 | 8 | 60 | 1 | 38 | 27 | 35 | 19 | 54 | 23 | 34 |
| R15 | 15 | 40 | 21 | 33 | 51 | 12 | 59 | 2 | 44 | 30 | 3 | 51 |
| R16 | 47 | 3 | 57 | 13 | 29 | 43 | 16 | 37 | 57 | 13 | 62 | 40 |
| R17 | 11 | 61 | 26 | 48 | 6 | 63 | 30 | 5 | 48 | 22 | 34 | 16 |
| R18 | 52 | 31 | 15 | 41 | 33 | 21 | 52 | 18 | 29 | 43 | 8 | 59 |
| R19 | 42 | 1 | 50 | 8 | 54 | 0 | 41 | 32 | 6 | 54 | 37 | 19 |
| R20 | 27 | 58 | 13 | 39 | 28 | 56 | 12 | 45 | 61 | 14 | 25 | 55 |
| R21 | 32 | 22 | 45 | 32 | 15 | 23 | 38 | 28 | 4 | 50 | 34 | 3 |
| R22 | 52 | 3 | 61 | 6 | 44 | 62 | 2 | 52 | 20 | 41 | 10 | 46 |
| R23 | 18 | 39 | 16 | 49 | 26 | 13 | 47 | 11 | 58 | 26 | 60 | 20 |
| R24 | 23 | 33 | 55 | 10 | 36 | 57 | 18 | 35 | 40 | 6 | 32 | 2 |
| R25 | 53 | 0 | 41 | 30 | 4 | 40 | 31 | 0 | 50 | 23 | 54 | 35 |
| R26 | 27 | 62 | 14 | 60 | 23 | 53 | 15 | 63 | 28 | 10 | 39 | 8 |
| R27 | 49 | 17 | 37 | 28 | 9 | 45 | 36 | 12 | 42 | 59 | 16 | 47 |
| R28 | 6 | 56 | 2 | 42 | 55 | 5 | 27 | 48 | 3 | 30 | 51 | 4 |
| R29 | 39 | 24 | 47 | 12 | 36 | 20 | 58 | 15 | 54 | 21 | 33 | 20 |
| R30 | 9 | 52 | 21 | 61 | 26 | 49 | 13 | 33 | 40 | 10 | 46 | 62 |
| R31 | 18 | 35 | 7 | 41 | 2 | 34 | 62 | 1 | 56 | 29 | 7 | 36 |
| R32 | 54 | 25 | 59 | 17 | 53 | 11 | 28 | 47 | 18 | 34 | 58 | 22 |

| | C13 | C14 | C15 | C16 | C17 | C18 | C19 | C20 | C21 | C22 | C23 | C24 |
|---|---|---|---|---|---|---|---|---|---|---|---|---|
| R1 | 57 | 31 | 7 | 52 | 15 | 41 | 24 | 36 | 19 | 60 | 25 | 17 |
| R2 | 16 | 48 | 21 | 34 | 56 | 17 | 59 | 11 | 51 | 1 | 32 | 49 |
| R3 | 33 | 2 | 61 | 25 | 3 | 47 | 5 | 45 | 29 | 42 | 58 | 20 |
| R4 | 40 | 51 | 18 | 36 | 41 | 28 | 63 | 14 | 23 | 7 | 35 | 10 |
| R5 | 30 | 8 | 45 | 10 | 58 | 7 | 18 | 48 | 37 | 54 | 16 | 50 |
| R6 | 38 | 59 | 16 | 53 | 34 | 22 | 52 | 31 | 2 | 27 | 61 | 3 |
| R7 | 26 | 3 | 47 | 28 | 0 | 44 | 24 | 56 | 20 | 45 | 17 | 52 |
| R8 | 35 | 55 | 21 | 42 | 19 | 62 | 9 | 28 | 49 | 10 | 38 | 6 |
| R9 | 19 | 38 | 9 | 60 | 30 | 5 | 47 | 32 | 4 | 60 | 29 | 54 |
| R10 | 5 | 28 | 46 | 16 | 35 | 54 | 14 | 58 | 18 | 42 | 21 | 0 |
| R11 | 34 | 57 | 2 | 55 | 12 | 38 | 22 | 44 | 36 | 12 | 51 | 36 |
| R12 | 10 | 24 | 49 | 28 | 42 | 1 | 51 | 7 | 26 | 57 | 6 | 27 |
| R13 | 43 | 30 | 7 | 19 | 63 | 23 | 31 | 61 | 34 | 17 | 40 | 63 |
| R14 | 14 | 60 | 46 | 37 | 4 | 48 | 9 | 43 | 3 | 53 | 14 | 35 |

TABLE 2-continued

| Sample 32 × 32 Blue Noise Mask | | | | | | | | | | | | |
|---|---|---|---|---|---|---|---|---|---|---|---|---|
| R15 | 31 | 3 | 33 | 16 | 52 | 25 | 39 | 19 | 45 | 24 | 49 | 2 |
| R16 | 11 | 55 | 23 | 42 | 11 | 59 | 15 | 54 | 5 | 58 | 12 | 31 |
| R17 | 49 | 33 | 6 | 57 | 35 | 1 | 46 | 33 | 26 | 37 | 22 | 49 |
| R18 | 0 | 26 | 48 | 13 | 27 | 56 | 22 | 7 | 62 | 9 | 55 | 0 |
| R19 | 45 | 34 | 21 | 63 | 43 | 15 | 49 | 29 | 43 | 20 | 41 | 26 |
| R20 | 13 | 61 | 8 | 31 | 2 | 37 | 10 | 53 | 3 | 38 | 11 | 50 |
| R21 | 49 | 17 | 42 | 53 | 18 | 50 | 34 | 17 | 59 | 24 | 58 | 29 |
| R22 | 24 | 38 | 4 | 30 | 59 | 6 | 28 | 46 | 7 | 44 | 15 | 4 |
| R23 | 56 | 12 | 47 | 20 | 41 | 22 | 62 | 14 | 54 | 23 | 35 | 52 |
| R24 | 42 | 26 | 58 | 9 | 27 | 53 | 2 | 39 | 33 | 0 | 62 | 8 |
| R25 | 15 | 49 | 0 | 44 | 34 | 18 | 48 | 26 | 16 | 50 | 32 | 21 |
| R26 | 62 | 20 | 36 | 61 | 14 | 50 | 10 | 40 | 59 | 11 | 25 | 48 |
| R27 | 25 | 54 | 6 | 31 | 39 | 3 | 58 | 29 | 4 | 53 | 44 | 17 |
| R28 | 34 | 11 | 48 | 13 | 24 | 52 | 17 | 46 | 22 | 32 | 9 | 36 |
| R29 | 52 | 38 | 18 | 58 | 42 | 8 | 38 | 13 | 61 | 43 | 19 | 63 |
| R30 | 1 | 29 | 46 | 4 | 26 | 63 | 28 | 53 | 1 | 27 | 51 | 2 |
| R31 | 15 | 60 | 11 | 55 | 37 | 19 | 9 | 40 | 23 | 47 | 14 | 39 |
| R32 | 43 | 24 | 44 | 23 | 0 | 51 | 31 | 55 | 6 | 30 | 57 | 9 |

| | C25 | C26 | C27 | C28 | C29 | C30 | C31 | C32 |
|---|---|---|---|---|---|---|---|---|
| R1 | 61 | 29 | 11 | 55 | 3 | 62 | 19 | 46 |
| R2 | 3 | 53 | 40 | 18 | 33 | 40 | 11 | 32 |
| R3 | 37 | 30 | 5 | 59 | 7 | 53 | 37 | 5 |
| R4 | 47 | 13 | 45 | 24 | 44 | 14 | 26 | 56 |
| R5 | 25 | 63 | 17 | 56 | 19 | 51 | 33 | 1 |
| R6 | 43 | 8 | 35 | 0 | 39 | 9 | 61 | 15 |
| R7 | 30 | 23 | 58 | 48 | 31 | 21 | 43 | 29 |
| R8 | 47 | 12 | 41 | 5 | 25 | 55 | 4 | 50 |
| R9 | 24 | 38 | 19 | 59 | 41 | 12 | 39 | 14 |
| R10 | 62 | 8 | 51 | 15 | 28 | 62 | 24 | 54 |
| R11 | 17 | 45 | 29 | 1 | 52 | 8 | 37 | 2 |
| R12 | 48 | 12 | 35 | 44 | 22 | 32 | 47 | 20 |
| R13 | 5 | 55 | 19 | 60 | 4 | 54 | 14 | 61 |
| R14 | 25 | 41 | 7 | 27 | 39 | 12 | 43 | 0 |
| R15 | 45 | 21 | 57 | 44 | 16 | 50 | 28 | 55 |
| R16 | 60 | 10 | 31 | 2 | 62 | 21 | 8 | 33 |
| R17 | 16 | 38 | 55 | 19 | 32 | 44 | 59 | 24 |
| R18 | 42 | 7 | 25 | 46 | 11 | 37 | 4 | 36 |
| R19 | 63 | 34 | 53 | 1 | 51 | 18 | 55 | 12 |
| R20 | 9 | 22 | 28 | 60 | 14 | 29 | 45 | 20 |
| R21 | 47 | 13 | 49 | 7 | 42 | 35 | 4 | 63 |
| R22 | 33 | 56 | 31 | 23 | 59 | 15 | 50 | 10 |
| R23 | 18 | 37 | 1 | 46 | 13 | 32 | 40 | 36 |
| R24 | 42 | 11 | 61 | 25 | 53 | 3 | 57 | 7 |
| R25 | 57 | 27 | 44 | 6 | 38 | 29 | 16 | 43 |
| R26 | 2 | 39 | 13 | 48 | 16 | 63 | 47 | 10 |
| R27 | 56 | 30 | 23 | 59 | 36 | 1 | 32 | 20 |
| R28 | 8 | 48 | 4 | 43 | 20 | 30 | 56 | 43 |
| R29 | 30 | 14 | 53 | 27 | 9 | 50 | 5 | 26 |
| R30 | 41 | 58 | 17 | 36 | 61 | 16 | 37 | 60 |
| R31 | 26 | 6 | 52 | 0 | 46 | 34 | 12 | 42 |
| R32 | 45 | 22 | 33 | 43 | 21 | 27 | 57 | 1 |

Figure 4:
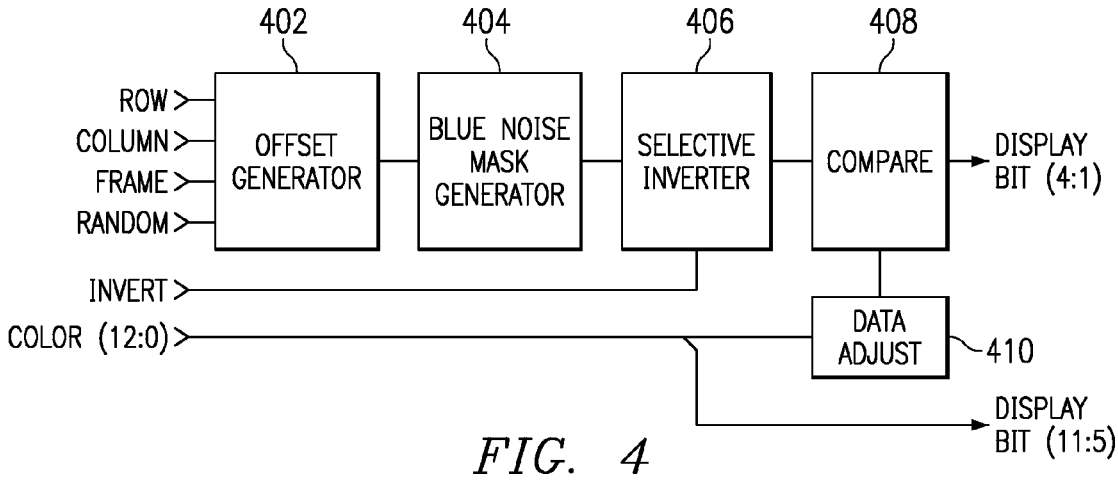
FIG. 4 is a block diagram showing the signal processing used to implement one embodiment of the present invention having multi-level masking.

FIG. 4 is a block diagram of the circuitry or software used to implement the blue noise multilevel masking system described above. Offset generator 402 creates an offset address used to index the blue noise mask generator 404. Many signals may be used to create an offset, including the row, column, and frame number being processed, and perhaps a random number. These inputs result in an index signal used to address the blue noise mask generator 404.

The blue noise mask generator 404 outputs a threshold value for each input index address received from the offset generator 402. The blue noise mask generator 404 typically is implemented as a memory lookup table. For the example shown above in Table 1, the blue noise mask generator 404 may be a 1024 location memory look up table.

The output of the blue noise mask generator 404, which may be the threshold value itself or a signal representing which threshold is being used, is an input to a selective inverter 406. The selective inverter 406 provides the option of inverting the blue noise mask. As described above, the inversion process typically is performed by subtracting each threshold in the un-inverted mask from the maximum threshold value in the entire mask.

The mask is not only inverted periodically, it is also shifted from time to time. When displaying scenes without motion, shifting the mask every other frame is sufficient. When displaying scenes with motion, the mask typically is shifted each frame. The continual shifting and inverting of the mask reduces the visible artifacts created by the fractional bits.

The value from the mask generator 404, whether inverted or not, is compared to the LSBs of the input data word. This comparison yields the fractional bit values shown above in Table 1 as Bits 1-3. The comparator 408 receives altered input data from a data adjust block 410. The data adjust block 410 receives the LSBs of the input data word and apportions the intensity between the various fractional bits, Bits 1-3, and the first binary bit, Bit 4, as indicated in Table 1. Thus, the data adjust block 410 controls when and how each more significant bit is feathered in as the input data values increase. At higher intensity levels the effects of PWM temporal artifacts are less noticeable and the dithering of the first binary data bit, Bit 4 in Table 1, can be stopped.

The data adjust block 410 typically outputs a data word for each of the fractional bits. Each of these data words is then compared to the thresholds generated by the mask generator 404 to determine whether the corresponding fractional bit will be enabled. A separate mask may be used for each fractional bit, or the same mask may be used for all of the fractional bits of a given pixel.

Figure 5:
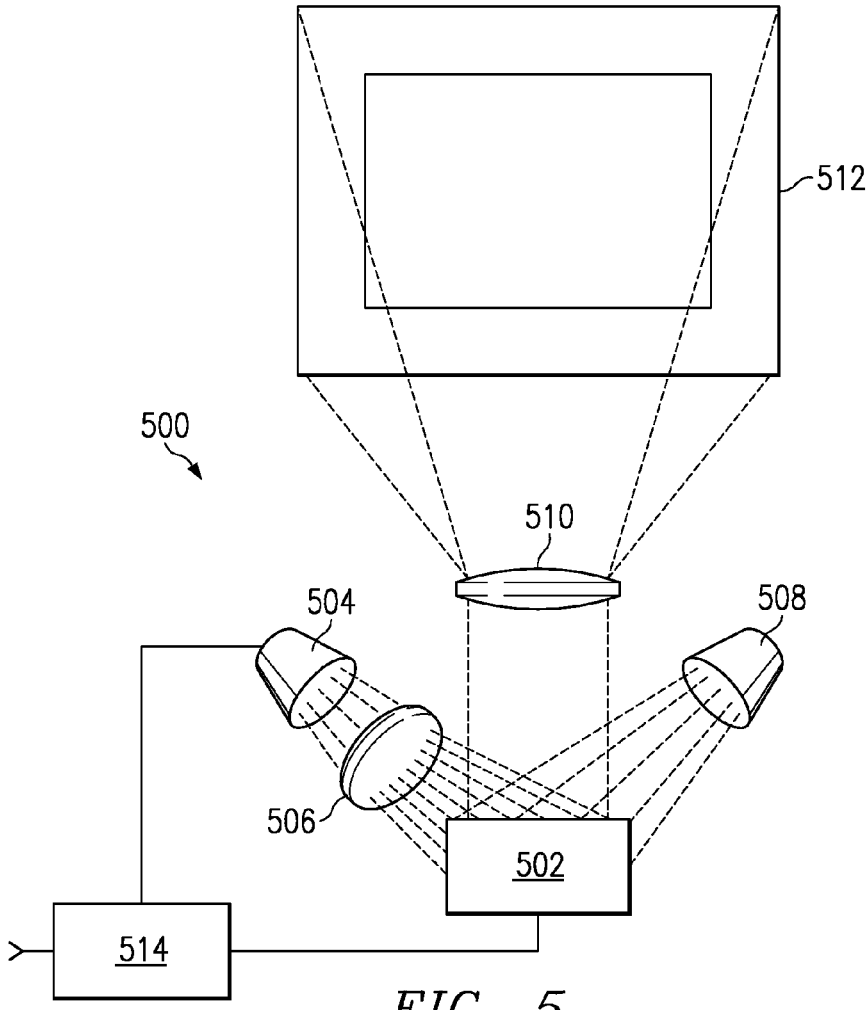
FIG. 5 is a schematic view of a micromirror-based projection system utilizing the multi-level masking of one embodiment of the present invention.

FIG. 5 is a schematic view of a micromirror-based image projection system 500 according to the present invention. In FIG. 5, light from light source 504 is focused on the micromirror 502 by lens 506. Although shown as a single lens, lens 506 is typically a group of lenses and mirrors which together focus and direct light from the light source 504 onto the surface of the micromirror device 502. Image data and control signals from controller 514, which include the integer and fractional bit planes described above, cause some mirrors to rotate to an on position and others to rotate to an off position. Mirrors on the micromirror device that are rotated to an off position reflect light to a light trap 508 while mirrors rotated to an on position reflect light to projection lens 510, which is shown as a single lens for simplicity. Projection lens 510 focuses the light modulated by the micromirror device 502 onto an image plane or screen 512.

Thus, although there has been disclosed to this point a particular embodiment for spatial temporal multiplexing using multi-level threshold masks and a method therefore, it is not intended that such specific references be considered as limitations upon the scope of this invention except insofar as set forth in the following claims. Furthermore, having described the invention in connection with certain specific embodiments thereof, it is to be understood that further modifications may now suggest themselves to those skilled in the art, it is intended to cover all such modifications as fall within the scope of the appended claims. In the following claims, only elements denoted by the words "means for" are intended to be interpreted as means plus function claims under 35 U.S.C. §112, paragraph six.

What is claim is:

1. A method of generating a display bit mask, the method comprising:

receiving a video data stream containing an image;

determining a motion value for said image;

generating an index value;

receiving a value for a cell of a first display bit mask using said index value;

selectively subtracting said received value from a maximum bit mask value; and using said received value or the result of said subtracting step as an inverted mask cell value, wherein the frequency of generating said index value depends on said motion value.

2. The method of claim 1, wherein said index value is generated every frame.

3. The method of claim 1, wherein said index value is generated every other frame.

4. The method of claim 1, wherein said index value is generated every frame when said motion value is below a threshold.

5. The method of claim 1, wherein said index value is generated every other frame when said motion value is above a threshold.

6. The method of claim 1, wherein said selective subtraction occurs every other frame.

* * * * *